United States Patent [19]

Hardesty et al.

[11] 4,422,246

[45] Dec. 27, 1983

[54] PROCESS FOR FEEDING SLURRY-PRESSURIZED AND SOLVENT-DEWATERED COAL INTO A PRESSURIZED ZONE

[75] Inventors: Donald E. Hardesty, Brookshire; Glenn R. McCullough, Houston, both of Tex.

[73] Assignee: Shell Oil Company, Houston, Tex.

[21] Appl. No.: 358,168

[22] Filed: Mar. 15, 1982

[51] Int. Cl.[3] ..... F26B 3/00; F26B 7/00

[52] U.S. Cl. ..... 34/9; 34/12; 44/10 J

[58] Field of Search ..... 34/9, 12; 44/10 J

[56] References Cited

U.S. PATENT DOCUMENTS 3,327,402 6/1967 Lamb et al. ..... 44/1 C 4,223,449 9/1980 Bodle et al. ..... 34/9

*Primary Examiner*—John J. Camby

[57] ABSTRACT

Substantially dry coal fines are fed into a pressurized zone by slurrying coal fines with a liquid, water-miscible, volatile organic solvent to form a pumpable slurry, pressurizing the slurry, removing and recycling the organic solvent component of the liquid phase of the slurry, thermally drying the pressurized fines and transporting the dried, pressurized fines into the pressurized zone.

5 Claims, 1 Drawing Figure

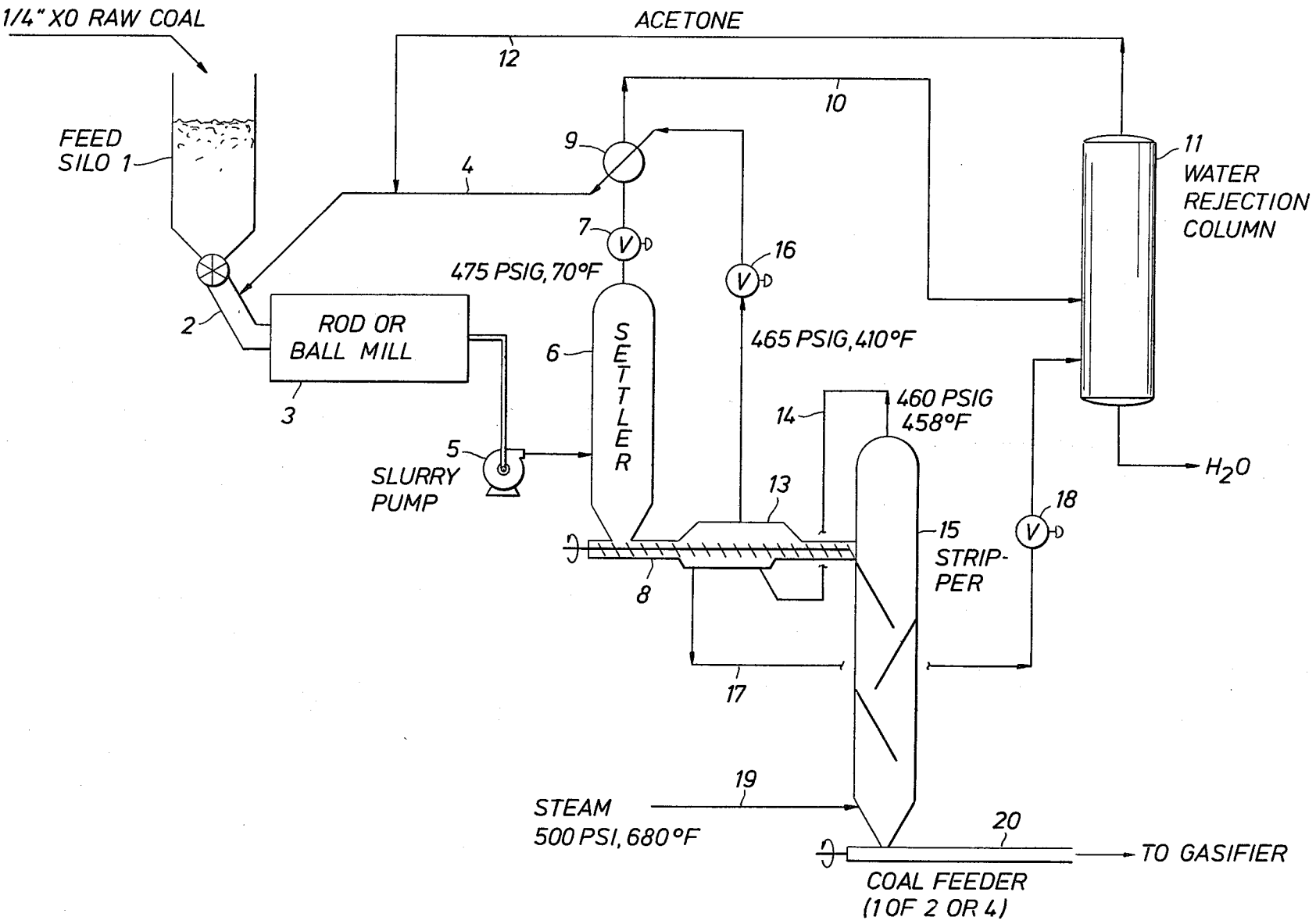
11
WATER REJECTION COLUMN
$H_2O$
TO GASIFIER
18
20
COAL FEEDER (1 OF 2 OR 4)
15
STRIP-PER
460 PSIG 458°F
465 PSIG, 410°F
10
14
13
16
17
19
ACETONE
8
9
7
S E T T L E R
6
STEAM 500 PSI, 680°F
12
4
475 PSIG, 70°F
5
SLURRY PUMP
ROD OR BALL MILL
3
2
1/4" X0 RAW COAL
FEED SILO 1

PROCESS FOR FEEDING SLURRY-PRESSURIZED AND SOLVENT-DEWATERED COAL INTO A PRESSURIZED ZONE

BACKGROUND OF THE INVENTION

For many years, various procedures have been proposed for solving the difficult problem of feeding fine coal into a pressurized zone, such as the interior of a gasifier, without encountering severe apparatus costs and maintenance problems or water-induced losses of thermal or chemical efficiency. The commonly employed lock-hoppers are known to be both expensive to manufacture and difficult to maintain. And, the injecting of pressurized aqueous slurries of coal fines is known to provide a thermal burden in a gasifier.

U.S. Pat. No. 3,182,825 suggests avoiding the inefficiency of lock-hoppers by centrifugally pumping pulverized dry coal into the interior of a gasifier.

U.S. Pat. Nos. 3,957,460; 4,153,427 and 4,244,706 suggest pressurizing aqueous slurries of coal and then partially combusting some of the coal in order to provide relatively dry coal at the pressure of a hydrotreater or gasifier.

U.S. Pat. No. 4,209,304 suggests extruding moist coal into hot gas, drying the resultant dispersion, and then feeding the dried dispersion into a gasifier.

Organic solvents, particularly those which are miscible with both oil and water, are known to be useful for dewatering coal fines. U.S. Pat. No. 3,327,402 by T. J. Lamb, E. L. Mitch and W. C. Naumann describes a process of dewatering coal to a selected degree by contacting wet coal fines with an organic solvent which is at least 10% miscible with water and then removing at least a substantial portion of the water-solvent solution from the coal particles. U.S. Pat. No. 4,185,395 describes an organic solvent-aided process for dewatering raw brown coal to form a relatively water-free slurry of raw brown coal fines in a liquid organic solvent.

SUMMARY OF THE INVENTION

The present invention relates to feeding substantially dry coal fines into a pressurized zone. Moist coal fines are mixed with a relatively water-miscible, volatile, organic solvent to form a pumpable slurry of coal fines in water-containing liquid organic solvent. The slurry is pumped into a settling container in which the solids are free to sink while the liquid rises, and the pressure exceeds the pressure in the pressurized zone into which the coal is to be fed. Organic solvent is separated, from the liquid which rises in the settling container, and flowed into the means for mixing coal fines with organic solvent. The coal fines solids, which sink in the settling container, are displaced into heat-exchanging relationship with at least one hot pressurized gas in order to evaporatively remove a selected proportion of water and organic solvent from them at a pressure exceeding the pressure in the zone into which the coal is to be fed. The relatively dry and pressurized coal fines are then mechanically and/or pneumatically displaced into the pressurized zone.

DESCRIPTION OF THE DRAWING

FIG. 1 is a schematic flow diagram for a preferred embodiment of the present invention.

DESCRIPTION OF THE INVENTION

The present invention is premised on a discovery that numerous advantageous savings in amount of equipment and cost of operation for feeding coal fines into a pressurized zone can be obtained by combining a solvent-dewatering procedure, such as that described in the above-mentioned U.S. Pat. No. 3,327,402, with a slurry pressurization and pressurized particle displacement of the coal fines. The disclosures of the U.S. Pat. No. 3,327,402 are incorporated herein by cross-reference.

The present combination of solvent-dewatering with slurry pressurization and pressurized particle displacement is capable of providing advantages such as the following. Relatively small coal particles, preferably in the order of ¼-inch to 0, can be wet-ground in contact with the organic solvent being used—and this eliminates the need for bag houses to remove dust, reduces the dust explosion hazard, etc. In feeding a coal gasifier, a number of the vessels and pumps that would otherwise be duplicated in the conventional drying and feeding functions are utilized in a manner which facilitates both the drying and the feed-pressurizing elements of the gasifier feeding system. In addition, the coal being fed into the pressurized zone receives a significant degree of preheating, which provides a thermal burden-reduction advantage for a gasifier or other thermal treating vessel.

The drawing shows a flow diagram for employing acetone and steam while using the present process for feeding a gasifier operating at 30 bars, or about 450 psig. In the embodiment shown, ¼–0 inch raw coal is supplied, in a conventional manner, from feed silo 1. The coal is conveyed, e.g., by gravity, through conduit 2 into a mixing and/or grinding device 3, such as a rod or ball mill. The coal in the mixing device is mixed with an organic solvent such as acetone fed through conduit 4. The coal and the solvent are preferably initially combined within the conduit 2.

In general, the ratio of the solvent to the coal solids is adjusted to provide, as the output of the mixing or grinding means, a pumpable slurry of coal particles which are preferably smaller than about 1 mm within a liquid mixture of the solvent and the water in or associated with the coal. Where the coal particles are ground within a coal-solvent mixing device, the coal used can be substantially any which is suitable for wet-grinding in a comminuting device, such as a conventional grinder; and, if desired, additional solvent can be flowed into the grinder and/or its output conduit, in order to adequately wet the increasingly larger surface areas of the particles being ground, or to provide sufficient liquid for a pumpable slurry of the fines, or the like.

The coal-solvent slurry is flowed into a liquid pumping means, such as pump 5, which is preferably a positive-displacement slurry pump. The pump pressurizes the slurry while injecting it into settling container 6 in which the solids are free to sink while the liquid rises. The outflow of liquid from the settling container is controlled by a throttling means, such as valve 7 while the outflow of the sinking coal solids is controlled by a particle displacing device such as an auger 8, so that the pressure in settler 6 is increased to about 475 psig at an ambient temperature of 70° F.

The liquid rising from settler 6 is a mixture of organic solvent (acetone) and water. It is preheated in a heat exchanger 9 and conveyed through conduit 10 to a means for separating the solvent from water, such as the water rejection column 11. The separated acetone is conveyed by conduit 12 into the coal-solvent mixing device, for example via a junction with conduit 4 for feeding acetone into that device.

The coal fines sinking within the settling container 6 are displaced by auger 8 into a heat-exchanging relationship with a hot pressurized gas in pressurized gas-heated auger section 13, in which the fines are preheated by hot gas inflowing through conduit 14. That gas is the gaseous output of stripper 15 and consists essentially of a mixture of steam and acetone at about 460 psig and 465° F. The acetone evaporated during the preheating is outflowed through conduit 4 against the back pressure of a throttling valve 16, so that the pressure and temperature on the fines are about 465 psig and 420° F. The outflowing acetone is cooled in heat exchanger 9 and fed through conduit 4 into the coal-acetone mixing device 3.

The predominantly aqueous liquid component of the gas which was fed into the heat exchange portion 13 of auger 8 exits through conduit 17 against the back pressure of throttle valve 18. That liquid, at about 410° F., heats the fluids in the water rejection column 11, to enhance the separation of the acetone.

The preheated coal fines are displaced by auger 8 into stripper column 15 where they are heated by steam at about 500 psig and 680° F. which enters through conduit 19. In the stripper column, the coal fines are freed of substantially all water and acetone, for example by counter-current gravity downflow. And, subsequently, a coal feeder device, such as auger 20, displaces the hot, pressurized, dried fines into a pressurized zone, such as the interior of a gasifier operating at a pressure of about 450 psig or 30 bars.

The present process is particularly useful for feeding substantially dry preheated coal fines into a pressurized zone in which the coal is subjected to a reaction such as pyrolysis, gasification, hydro-gasification, or the like. It is particularly useful for feeding coal fines into a relatively high pressure and high temperature gasifier.

The coal fines which are mixed with the organic solvent in the present process can be preground, or otherwise comminuted, fine particles having upper sizes of less than about 1 mm. Such coal fines can comprise those which remain in an aqueous slurry of relatively fine coal after a mechanical removal of particles which are larger than that size, or such coal fines can be those formed by wet-grinding particles of coal particles submerged within the organic solvent being used in the present process.

Organic solvents suitable for use in the present invention can comprise substantially any of the low molecular weight organic solvents containing 1 to 4 carbon atoms described in the above-mentioned U.S. Pat. No. 3,327,402. A particularly preferred solvent is acetone. The proportion in which such solvents are mixed with the fine coal particles should be sufficient to provide a pumpable slurry of fine coal particles, such as particles of less than about 1 mm in size. In terms of parts by weight, the ratio of the organic solvent to the slurried coal fines is preferably in the range of from about 0.55 to 1.00 (e.g., lb. solvent/lb. coal).

The hot gas with which the coal fines are preheated and subsequently dried is preferably steam containing less than about 0.1% organic solvent.

In general, the equipment used can be substantially any, such as that which is presently available, suitable for providing the grinding, mixing, pressurizing, transporting, heating, separating, drying, and the like, functions specified above.

What is claimed is:

1. A process for feeding substantially dry coal fines into a pressurized zone comprising:

mixing moist coal fines with enough water-miscible, volatile, organic solvent containing from 1 to 4 carbon atoms to form a pumpable slurry of coal fines in water-containing liquid organic solvent;

pumping the slurry into a settling container, in which the solids are free to sink while the liquid rises, at a pressure exceeding the pressure in said pressurized zone;

separating organic solvent from the liquid which rises in said settling container and flowing the separated organic solvent into contact with said moist coal fines;

displacing the coal fines which sink in said settling container into heat exchange relationship with at least one hot pressurized gas which evaporates at least a significant portion of the water and organic solvent from the coal fines at a pressure exceeding the pressure in said pressurized zone to be fed; and, displacing the resulting pressurized and relatively dry coal fines into the pressurized zone to be fed.

2. The process of claim 1 in which the coal fines are mixed with the organic solvent by grinding coal particles which are smaller than about ¼ inch to particles which are smaller than about 1 millimeter while those particles are mixed with enough of the organic solvent to form a pumpable slurry.

3. The process of claim 1 in which said displacing of coal fines into a heat exchanging relationship between the coal fines and hot gas includes first contacting the fines with a solvent-containing steam resulting from a further steam drying of a preceding portion of fines and then further drying the fines by contacting them with steam substantially free of such solvent.

4. The process of claim 1 in which said organic solvent is acetone and said hot pressurized gas is steam.

5. The process of claim 1 in which the coal fines which sink in the solids settling container are displaced into said heat exchange relationship by an auger.

* * * * *